US009296505B2

(12) United States Patent
Osterrieder

(10) Patent No.: US 9,296,505 B2
(45) Date of Patent: Mar. 29, 2016

(54) PACKAGING MACHINE WITH TRANSPORT DEVICE

(75) Inventor: Franz Osterrieder, Bad Groenenbach (DE)

(73) Assignee: MULTIVAC SEPP HAGGENMUELLER GMBH & CO. KG, Wolfertschwenden (DE)

( * ) Notice: Subject to any disclaimer, the term of this patent is extended or adjusted under 35 U.S.C. 154(b) by 1007 days.

(21) Appl. No.: 13/458,292

(22) Filed: Apr. 27, 2012

(65) Prior Publication Data

US 2012/0272623 A1 Nov. 1, 2012

(30) Foreign Application Priority Data

Apr. 29, 2011 (EP) ..... 11003534

(51) Int. Cl.

| | |
|---|---|
| ***B65B 51/14*** | (2006.01) |
| ***B65B 31/02*** | (2006.01) |
| ***B65B 43/52*** | (2006.01) |
| ***B65B 7/16*** | (2006.01) |

(52) U.S. Cl.

CPC ..... *B65B 51/14* (2013.01); *B65B 7/164* (2013.01); *B65B 31/028* (2013.01); *B65B 43/52* (2013.01)

(58) Field of Classification Search

CPC ..... B65B 51/14; B65B 31/02; B65B 7/28; B65B 7/2878

USPC ..... 53/478, 287, 329, 329.2, 329.3, 329.4, 53/367

See application file for complete search history.

(56) References Cited

U.S. PATENT DOCUMENTS

| | | | | | |
|---|---|---|---|---|---|
| 3,471,992 | A | * | 10/1969 | Amberg et al. | 53/478 |
| 3,522,687 | A | * | 8/1970 | Mahaffy | 53/433 |
| 3,583,125 | A | * | 6/1971 | Vermeulen | 53/412 |
| 3,717,971 | A | * | 2/1973 | Naggert | 53/89 |
| 3,874,145 | A | * | 4/1975 | Schmidt | 53/510 |
| 4,691,500 | A | * | 9/1987 | Danforth et al. | 53/478 |
| 4,838,008 | A | * | 6/1989 | Hardy | 53/407 |
| 4,974,392 | A | * | 12/1990 | Mondini | 53/287 |
| 5,056,296 | A | * | 10/1991 | Ross et al. | 53/478 |
| 5,065,563 | A | * | 11/1991 | Robache | 53/69 |
| 5,475,965 | A | * | 12/1995 | Mondini | 53/287 |

(Continued)

FOREIGN PATENT DOCUMENTS

| | | | |
|---|---|---|---|
| DE | 102008030510 | A1 | 1/2010 |
| DE | 102008048831 | A1 | 4/2010 |

(Continued)

OTHER PUBLICATIONS

European Search Report Dated Oct. 31, 2011, Applicant Multivac Sepp Haggenmueller GmbH & Co. KG, Application No. 11003534.2-2308.

*Primary Examiner* — Gloria R Weeks

(74) *Attorney, Agent, or Firm* — Husch Blackwell LLP

(57) ABSTRACT

The disclosure relates to a packaging machine with a sealing station for sealing trays with a top film, where said sealing station comprises a sealing tool upper part and a tray carrier for lifting at least one tray to said sealing tool upper part. Said packaging machine according to the disclosure is characterized in that a transport means defines a transport plane for the tray bottom to be transported and is provided within an opening for said tray in said tray carrier in order to transport said tray in the transport plane along said tray carrier. The disclosure also relates to a corresponding method for operating a packaging machine.

16 Claims, 8 Drawing Sheets

(56) References Cited

U.S. PATENT DOCUMENTS

| | | | | |
|---|---|---|---|---|
| 6,550,224 | B2 * | 4/2003 | Kleinschmidt | 53/453 |
| 7,610,736 | B2 * | 11/2009 | von Seggern | 53/433 |
| 8,381,497 | B2 * | 2/2013 | Scheibel et al. | 53/449 |
| 2001/0011445 | A1 | 8/2001 | Scolaro | |
| 2004/0098947 | A1 * | 5/2004 | Konishi | 53/329.5 |
| 2009/0288365 | A1 * | 11/2009 | Negele | 53/329 |
| 2014/0069054 | A1 * | 3/2014 | Gabler | 53/329 |

FOREIGN PATENT DOCUMENTS

| | | | |
|---|---|---|---|
| EP | 1468913 | A1 | 10/2004 |
| WO | 2004056655 | A2 | 7/2004 |
| WO | 2011012652 | A1 | 2/2011 |
| WO | 2011018391 | A1 | 2/2011 |

* cited by examiner

PACKAGING MACHINE WITH TRANSPORT DEVICE

CROSS-REFERENCE TO RELATED APPLICATIONS

This application claims foreign priority benefits under 35 U.S.C. §119(a)-(d) to European patent application number EP 11003534.2 filed Apr. 29, 2011, which is incorporated by reference in its entirety.

TECHNICAL FIELD

The disclosure relates to a packaging machine and to a method for operating a packaging machine with a transport device.

BACKGROUND

A tray sealer is known from DE 10 2008 030 510 A1, in which a gripper system grips trays which were positioned on a feeding belt by means of two horizontally movable grippers. The grippers transport the trays into a sealing station in which they are sealed with a top film. After the sealing procedure, the sealed trays are transported out of the sealing station by the two grippers and transferred onto a discharge belt. The grippers simultaneously transport both the unsealed trays into the sealing station as well as the sealed trays out of the sealing station. Such a gripper system requires a large amount of space for the gripper movements that occur outside and in particular at the side of the sealing station, as well as for driving and guiding means of the gripper system. Prerequisite for the use of gripper systems is, that the trays are respectively grouped and position at a distance from the grippers on a feeding belt, after being fed to the feeding belt of the sealing machine at an irregular or non-matching distance. Such a gripper system cannot be used for an at least three-lane tray sealer.

SUMMARY

An object of a packaging machine according to the disclosure is to provide a space-saving and universally employable option with respect to the number of lanes, for transporting trays into and out of a sealing station.

A packaging machine according to the disclosure, preferably a tray sealer, comprises a sealing station for sealing containers with a top film, where the sealing station comprises a sealing tool upper part and a tray carrier for lifting at least one container or tray to the sealing tool upper part. A transport plane is defined for the tray bottom to be transported, where a transport device is provided in the tray carrier within an opening for the tray and adapted to transport the tray in the transport plane along the tray carrier. In this, the trays can be supplied by a feeding belt at an arbitrary distance, as they are received by the transport device and positioned according to the opening in the tray carrier.

Preferably, the transport device is multi-row and/or multi-lane, in particular three-lane or multi-lane, to increase the number of trays in the sealing tool and thereby enhance the performance of the packaging machine.

In a particularly advantageous embodiment, there are openings provided in the transport device for the tray carrier. This allows for the tray carrier in a lowered position to be able to be lowered into the transport device or the transport device is arranged in the openings intended for the trays such that the upper edge of the tray carrier is arranged at the same level or at only a small distance, preferably 0.1 mm to 5 mm, below the transport plane of the transport device.

The transport device preferably comprises at least one transport belt for transporting the tray by placing the container bottom or tray bottom onto the transport belt. A transport belt is flexible in its use, since different tray dimensions and shapes of tray bottoms can be transported. Given such a transport belt, the transport plane for the tray bottom to be transported is defined by the top side of the upper run of the transport belt. Deflection rollers provided for the transport belt preferably comprise adjustment means, enabling conversion to other formats in combination with a corresponding tray carrier without changing the transport unit or a transport belt.

The transport device preferably comprises deflection rollers to direct the path of the transport belt such that lowering the tray carrier into the transport device is enabled, since in this case the transport belt is deflected such that a free space is provided for the tray carrier. To achieve a minimal deflection radius, so-called knife edges are also employable.

It is advantageous if a first group of deflection rollers or knife edges is provided, which determines the position of the transport belt in the transport plane and ensures that the transport belt is deflected from this transport plane downwards or from below into the transport plane, respectively. Spacings or steps are formed along the transport path by means of this deflection of the transport belt, into which the tray carrier can be lowered, so that it no longer protrudes upwardly above the transport plane and thus does not impair transportation of the trays on the transport device. A second group of deflection rollers, possibly having a larger diameter than the first group of deflection rollers, is preferably provided further below. The clearance between the upper end of a deflection roller of this second group of deflection rollers and the transport plane should at least correspond to the height of the tray carrier, preferably even be a bit larger so that the tray carrier in its lowered position still may well be above the deflection rollers but precisely does not protrude upwards beyond the transport plane. It is conceivable that the transport belt is guided around the rollers of this second group of deflection rollers in a U-shape. The diameter of this second group of deflection rollers thus determines the width of a spacing of the transport device, into which the tray carrier can be lowered.

The tray carrier preferably comprises a surface for receiving a tray edge, which during transportation of the tray is preferably at the same height or below the transport plane. In this, the tray can be slid on the surface of the tray carrier during transportation along the tray carrier when the tray bottom is not completely received by the transport device. This mainly occurs in the transition from a feeding belt to the transport system or between two adjacent openings of the tray carrier in the transport direction.

During the tray transfer from a feeding device to the transport device, the velocities of the transport belt of the transport device and a feeding unit, such as a feeding belt, of the feeding device are preferably synchronized, in order to thus also transfer information on the position of a tray, given in a control means of the feeding unit, to the transport device without any further sensor systems.

In an advantageous embodiment, the transport device has a plurality of successively arranged transport belts according to the number of trays to be sealed in a lane. This enables positioning of individual trays in the region of the openings in the tray carrier, independent of neighboring trays.

In a method according to the disclosure for positioning at least one tray in a sealing station of a packaging machine by means of a transport device, the tray is transferred e.g., by a feeding device onto the transport device and positioned such that a tray carrier can lift the tray from the transport device and move it to a sealing tool upper part for sealing the tray with a top film. A transport plane for the tray bottom to be transported is defined by the transport device, and the transport device transports the tray within an opening provided for the tray in the tray carrier in the transport plane along the tray carrier. This method can also be employed in a multi-row and/or multi-lane packaging machine and enables transfer of individual trays or even of a pre-grouped number of trays.

Preferably, the tray carrier, after sealing, places the trays onto the transport belt and the transport device transfers the trays to a discharge device.

Preferably the transport device, in a limited time period during the period of transferring the sealed trays to the discharge device, simultaneously receives the trays to be newly sealed from the feeding device in order to further increase performance of the packaging machine.

Preferably, the tray carrier lifts multiple trays being provided in the tray carrier in correspondence to the openings, which are consecutively and/or adjacently transported by the transport device, in order to lead them towards the seal tool upper part so that it can seal the group of trays with a top film.

In an advantageous embodiment, a sensor detects the position of a tray on the feeding device or on the transport device and a controller controls the transport device such that the tray is positioned congruently to the opening of the tray carrier and the tray carrier can thus receive the tray.

The method is particularly suitable for multi-row and multi-lane tray sealers (tray sealing machines), in which trays filled with products are transported towards the sealing station via multiple feeding belts arranged in parallel, and are accordingly positioned or arranged, respectively, by the transport device within the sealing station. The method, however, is not limited thereto and further embodiments are conceivable In the following, an advantageous embodiment of the disclosure is further illustrated with reference to the below drawings.

BRIEF DESCRIPTION OF THE DRAWINGS

Identical components are in the figures designated throughout with the same reference numerals.

DETAILED DESCRIPTION

Figure 1:
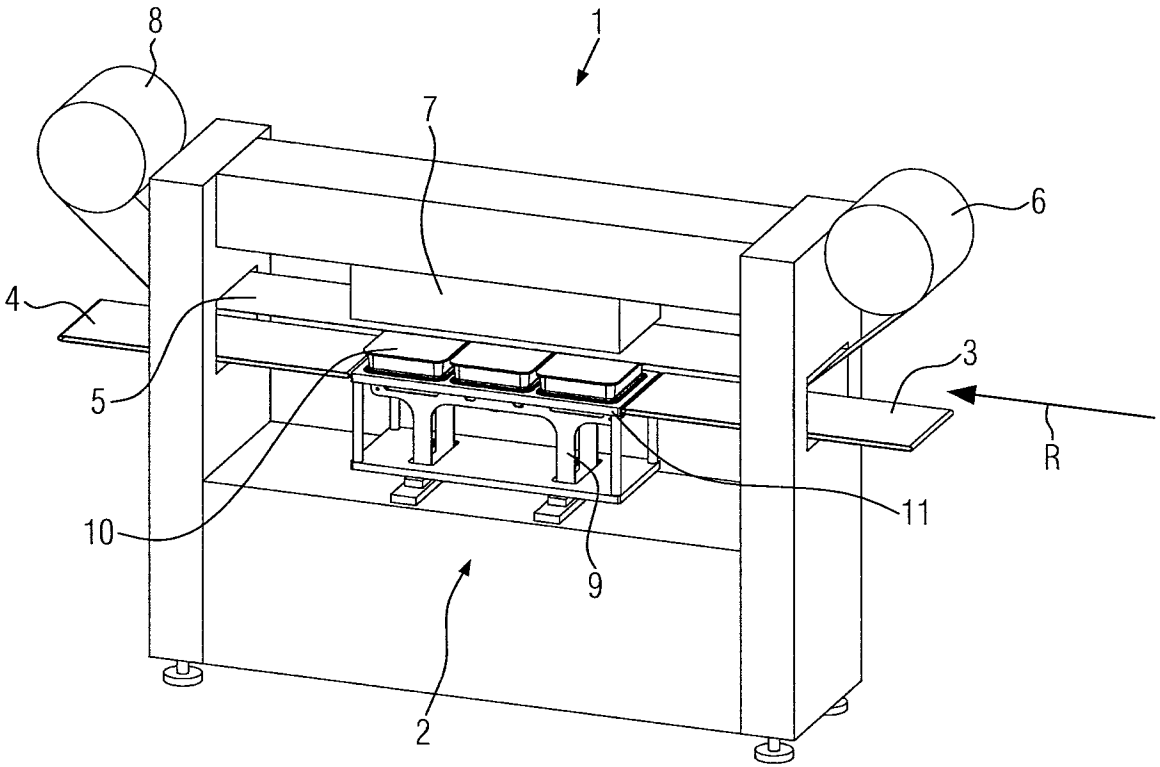
FIG. 1 shows a schematic view of a packaging machine according to the disclosure.

FIG. 1 shows a packaging machine 1 according to the disclosure in the form of a tray sealing machine, also referred to as tray sealer, with a sealing station 2, a feeding device 3 (including a movable feeding unit such as a movable feeding belt), and a discharge device 4 (including a movable discharge unit such as a movable discharge belt). A top film 5 is unrolled from a material storage 6, guided below a sealing tool upper part 7 and wound onto a residual film winder 8. A presently single-lane transport device 9 transports the trays 10 along a tray carrier 11. In this, the trays 10 are transported in a transport direction R by the packaging machine 1.

Figure 2A:
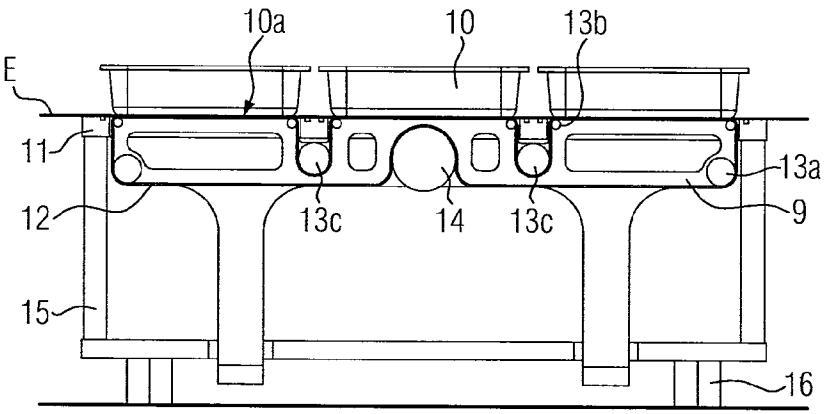
FIG. 2*a* shows a schematic side view of the transport device and the tray carrier in the transport position.

FIG. 2*a* shows the transport device 9 with a transport belt 12 and a plurality of deflection rollers 13*a*, 13*b* in the position in which the trays 10 are transported. A non-illustrated servo drive drives a shaft 14 via which the transport belt 12 is driven. The tray carrier 11 shown in its lowered position in FIG. 2*a* comprises a frame 15 which is connected to a non-illustrated lifting device by means of guides 16. The transport belt 12 is located in openings 20 (see FIG. 3) of the tray carrier on the same level as the upper side of the tray carrier or extends slightly above the tray carrier 11 and with its upper side defines a transport plane E for the tray bottom 10*a*. In this, the difference in height between the transport plane E and the tray carrier 11 is just large enough to ensure sufficient friction of the tray bottom 10*a* on the transport belt 12.

Figure 2B:
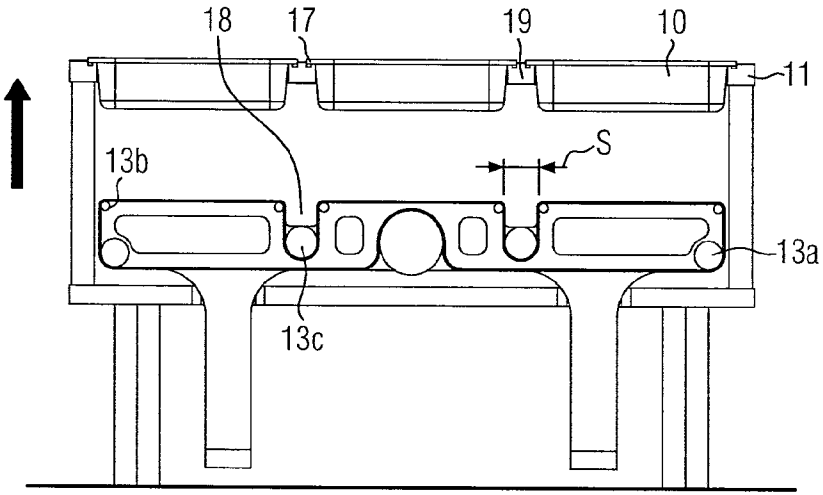
FIG. 2*b* shows a schematic side view of the transport device and the tray carrier in a lifted position.

FIG. 2*b* shows the tray carrier 11 in a lifted position, in which the trays 10 are received with their laterally projecting edge of the tray 17 by the tray carrier 11. Spacings 18 for the stays 19 of the tray carrier 11 are clearly visible, wherein the spacings 18 are enabled by the deflection rollers 13*a*, 13*b* and the resulting course performed by the transport belt 12. In this, the upper deflection rollers 13*b* are formed having a very small diameter in order to guide the transport belt 12 as closely as possible to the inner side of the opening 20 in the tray carrier 11, in order to be able to bridge the distance S corresponding to the spacing between two adjacent openings 20 in the tray carrier 11 or between two adjacent sections of the transport belt 12, respectively.

It is evident from FIGS. 2*a* and 2*b*, that the lower deflection rollers 13*a* together with the shaft 14 arranged in the center determine the course of the lower run of the transport belt 12. For determining the course of the upper run of the transport belt 12, a first group of deflection rollers 13*b* or carrier rollers, respectively, is provided which is located directly below the transport or conveying path. A second group, in this case, of two upper deflection rollers 13*c*, having a larger diameter than the carrier or deflection rollers 13*b* of the first group, is located at a greater distance downwardly from the transport plane E. The transport belt 12 is wrapped in a U-shape around these larger deflecting roll 13*c* of the second group. The deflection rollers of the first and the second group guide the upper run of the transport belt 12 such that two gaps or spacings 18 along the conveying path are created, into which the stays 19 of the tray carrier 11 can then be lowered. In the vertical direction, the distance between the upper side of the defection rollers 13*c* of the second group and the transport plane E is large enough for the tray carrier 11 in its lowered position not to extend upwards beyond the transport plane E, but preferably to be completely below the transport plane E. The deflection rollers 13*b* of the first group of upper deflection rollers have a diameter smaller than the deflection rollers 13*c* of the second group of upper deflection rollers 13*b*, so that the spacings 18 are in the horizontal direction preferably not much wider than the stays 19 of the tray carrier 11.

Figure 3:
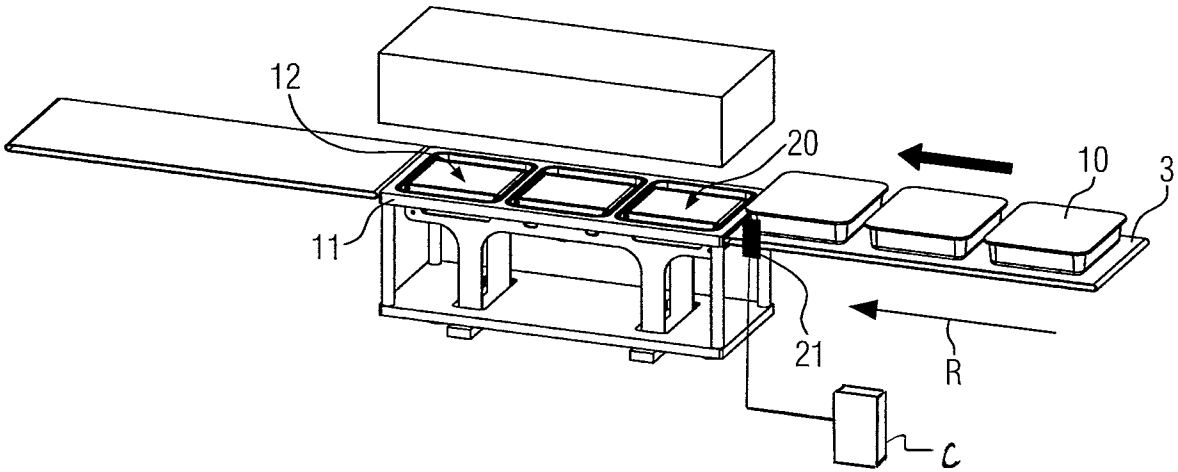
FIG. 3 shows a schematic view of a sealing station with a feeding and discharge device having trays on the feeding device.

FIG. 3 shows three pre-grouped trays 10 on a feeding device 3 and a tray carrier 11 with three openings 20 for receiving a group of three trays 10. A sensor 21 at the end of the feeding device 3 detects, for example, the front edge of the tray 10 that is located closest to the transport device 9, and communicates this position to a controller C. The controller C is preferably also provided for controlling and actuating all of the drives existing in the packaging machine 1.

Figure 4:
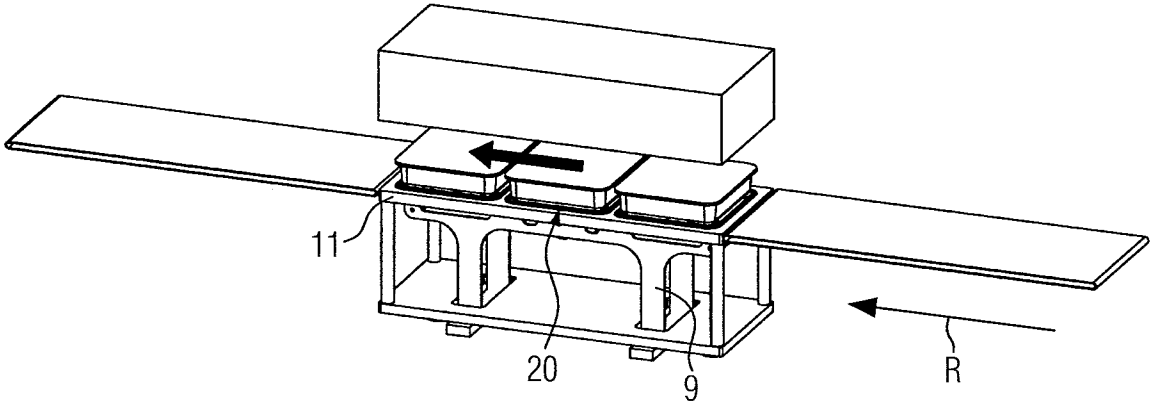
FIG. 4 shows a schematic view similar to FIG. 3 with containers on the transport system.

FIG. 4 shows how the trays 10, after being positioned by the transport device 9 along the tray carrier 11 in the transport direction R, are congruent with the openings 20 of the tray carrier 11.

Figure 5:
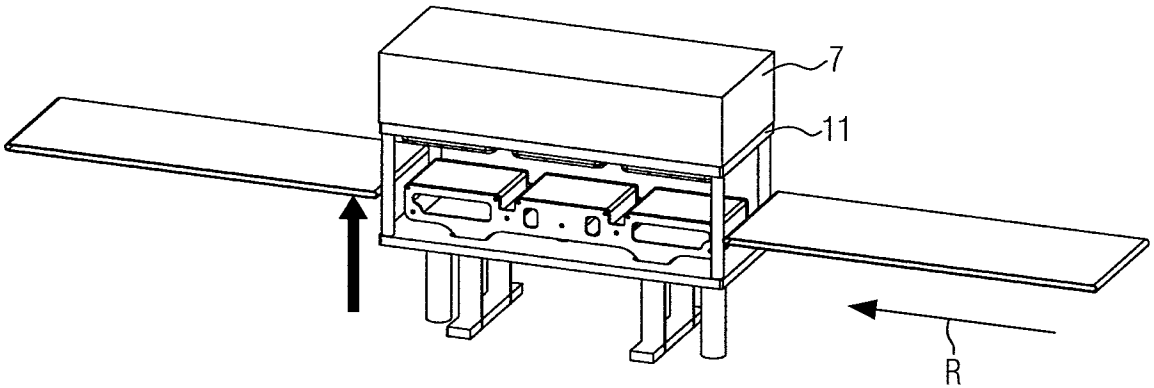
FIG. 5 shows a schematic view similar to FIG. 4 with a lifted tray carrier.

FIG. 5 shows the tray carrier 11 in a lifted position with respect to the sealing tool upper part 7 for sealing the trays 10 with a top film 5, not shown in this figure. The sealing procedure can presently also be performed in a vacuum or modified atmosphere.

Figure 6:
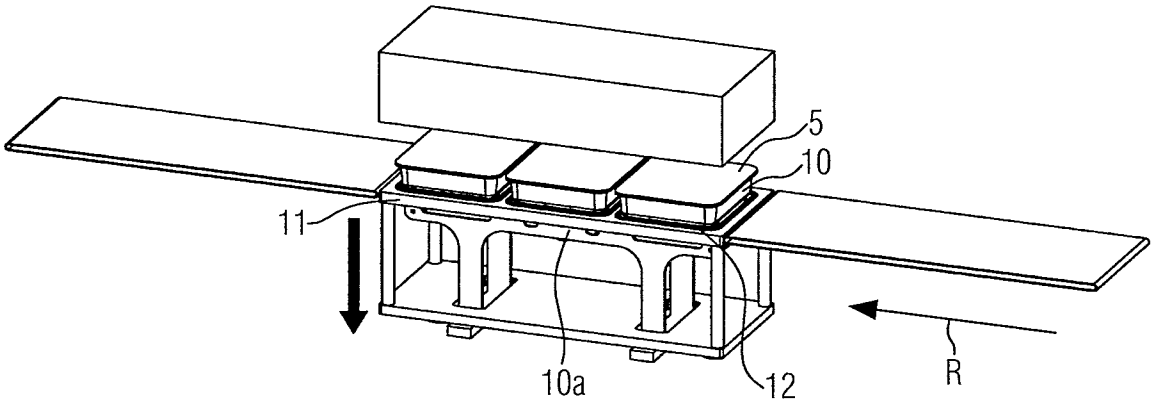
FIG. 6 shows a schematic view similar to FIG. 3 with sealed trays placed on the transport system.

FIG. 6 shows the tray carrier 11 again in the lowered position like in FIG. 4. The three trays 10 are sealed with a part of the top film 5 and the tray bottom 10*a* is located on the transport belt 12 of the transport device 9.

Figure 7:
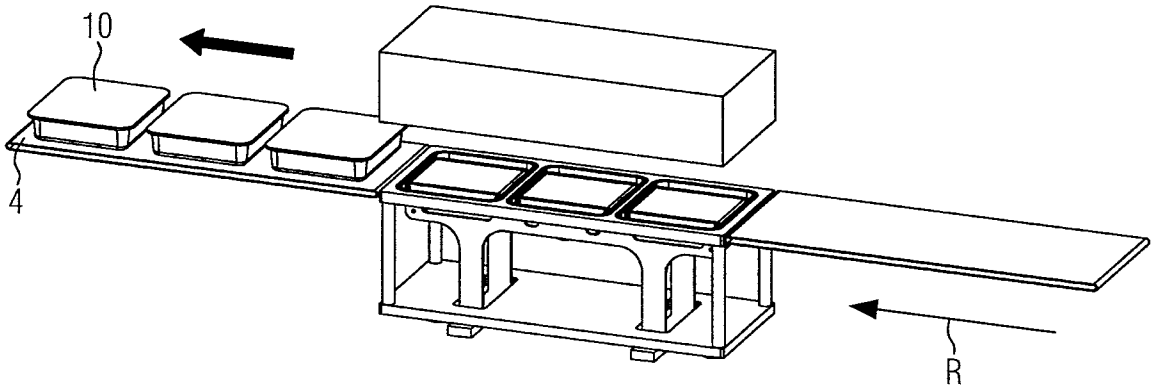
FIG. 7 shows a schematic view similar to FIG. 6 with trays on the discharge device.

FIG. 7 shows the transfer of the sealed tray 10 to the discharge device 4, which supplies the trays 10 to further production steps, such as examination by means of a metal detector, weighing or labeling.

Figure 8:
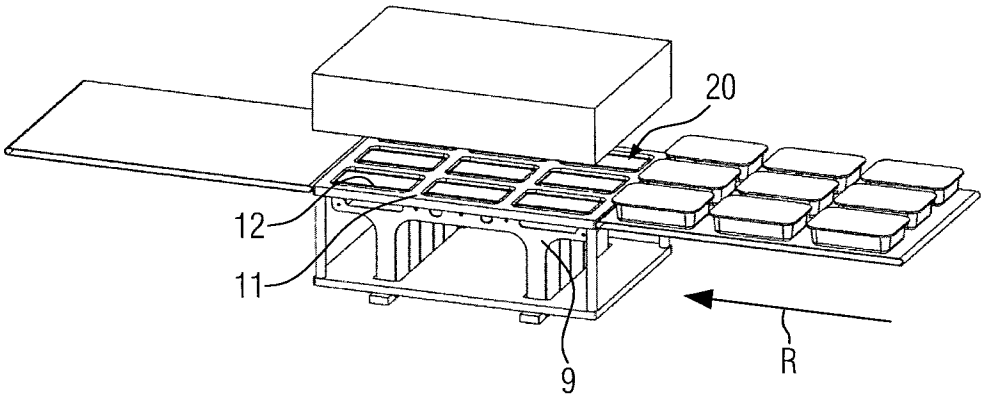
FIG. 8 shows a schematic view of a three-row and three-lane embodiment.

FIG. 8 shows a three-row and three-lane version of the transport device 9 with three adjacent transport belts 12 arranged in parallel in the transport direction R. The tray carrier 11 respectively comprises nine openings 20.

As a further variant, it is conceivable both for single-lane as well as multi-lane packaging machines, that for each opening 20 in the tray carrier 11, a separate transport belt 12 is provided, which is driven either individually or in groups by means of a servo drive and is controlled by a machine control.

The transport device 9 is capable to also receive trays 10, which are not pre-positioned on a feeding device 3, from the feeding device and to position them congruently with the openings 20. Each of the transport belts 12 may be synchronized with the feeding device 3 or any upstream or downstream transport belt 12 of the transport device 9.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A packaging machine comprising:

a sealing station for sealing trays with a top film, the sealing station comprising a sealing tool upper part, a tray carrier having an opening for receiving a tray and being configured to lift the tray to the sealing tool upper part, and a transport device for transporting the tray and defining a transport plane for a tray bottom of the tray, wherein the transport device comprises at least one transport belt and deflection rollers to direct the path of the at least one transport belt to enable lowering of the tray carrier into the transport device and wherein the transport device is receivable within the opening provided for the tray in the tray carrier, in order to transport the tray in the transport plane along the tray carrier.

2. The packaging machine according to claim 1 wherein the transport device comprises multiple rows and/or multiple lanes.

3. The packaging machine according to claim 1 wherein the transport device defines spacings for receiving the tray carrier.

4. The packaging machine according to claim 1 wherein the deflection rollers comprises a first group of upper deflection rollers and a second group of upper deflection rollers, and wherein the first group of upper deflection rollers is arranged above the second group of upper deflection rollers.

5. The packaging machine according to claim 1 wherein the tray carrier comprises an area for receiving a tray edge of the tray, and wherein the area of the tray carrier is configured to be at the same height of or below the transport plane during transport of the tray by the transport device.

6. The packaging machine according to claim 1 wherein the transport device comprises at least two transport belts arranged in parallel in a transport direction.

7. The packaging machine according to claim 1 further comprising a feeding device having a movable feeding unit for feeding the tray to the transport device, wherein the transport device includes a movable transport belt, and wherein, during transfer of the tray from the feeding device to the transport device, the transport device and the feeding device are configured to be operated such that velocities of the transport belt and the feeding unit are synchronized.

8. The packaging machine according to claim 1 wherein the sealing station is configured to simultaneously seal multiple trays arranged in a lane, and the transport device comprises a number of consecutively arranged transport belts corresponding to the number of trays to be sealed in the lane.

9. A method for positioning a tray in a sealing station of a packaging machine, the method comprising:

lowering a tray carrier to a lowered position so that an upper side of a tray carrier is at or below a transport plane of the tray, the transport plane defined by a transport device of the sealing station;

receiving at least a portion of the transport device within an opening defined in the tray carrier when the tray carrier is in the lowered position;

positioning the tray with the transport device on the transport plane such that a bottom of the tray is positioned within the opening defined in the tray carrier;

lifting the tray from the transport plane to the sealing tool upper part by raising the tray carrier from the lowered position to a raised position so that the tray engages a top film proximate the sealing tool upper part.

10. The method according to claim 9 further comprising lowering the tray with the tray carrier from the raised position to the lower position to engage the transport device after the tray has been sealed; and transferring the sealed tray to a discharge device using the transport device.

11. The method according to claim 10 further comprising, simultaneously transferring an additional tray from a feeding device to the sealing station using the transport device during the transferring the sealed tray to the discharge device step.

12. The method according to claim 9 wherein the positioning step further comprises transporting multiple trays consecutively and/or adjacently by the transport device, and the lifting the tray from the transport plane to the sealing tool upper part step further comprises simultaneously lifting the multiple trays with the tray carrier.

13. The method according to claim 9 further comprising detecting with at least one sensor a position of the tray on the transport device or on a feeding device that feeds the tray to the transport device, and controlling the transport device with a controller such that the tray is positioned such that the bottom of the tray is positioned within the opening defined in the tray carrier.

14. A packaging machine comprising:

a sealing station for sealing trays with a top film, the sealing station comprising:

a sealing tool upper part, a transport device for transporting a tray and defining a transport plane for a bottom of a tray, a tray carrier having at least one opening for receiving a tray, the tray carrier being disposed for movement between a lowered position and a raised position for raising and lowering a tray between the transport plane and the sealing tool upper part, and wherein at least a portion of the transport device is received into the at least one opening in the tray carrier when the tray carrier is in the lowered position so that the transport device is disposed to convey a tray in the transport plane into the sealing station.

15. The packaging machine of claim 14 wherein the transport device comprises an endless belt guided by a plurality of guide rollers, wherein the guide rollers are disposed to create one or more spacings in an upper run of the endless belt, the one or more spacings comprising a recessed portion of the endless belt, the recessed portion extending in a direction perpendicular to a transport direction of the endless belt and having a width sufficient to receive a stay member of the tray carrier.

16. The packaging machine of claim 14 wherein the transport device is disposed to convey a tray in the transport plane out of the sealing station when the tray carrier is in the lowered position.

* * * * *